United States Patent [19]

Corona

[11] 4,297,616

[45] Oct. 27, 1981

[54] FLUORESCENT LAMP WITH INCANDESCENT BALLASTING SYSTEMS

[75] Inventor: Stephen C. Corona, Rochester, N.Y.

[73] Assignee: Xerox Corporation, Stamford, Conn.

[21] Appl. No.: 130,929

[22] Filed: Mar. 17, 1980

[51] Int. Cl.[3] ..... H05B 35/00; H05B 41/19

[52] U.S. Cl. ..... 315/179; 315/182; 315/234; 315/290; 315/DIG. 5; 355/70

[58] Field of Search ..... 355/69, 70; 315/49, 315/179, 180, 182, 106, 290, DIG. 2, DIG. 5, 234, 335

[56] References Cited

U.S. PATENT DOCUMENTS

| | | | |
|---|---|---|---|
| 2,586,402 | 2/1952 | Waguet | 315/290 X |
| 2,644,108 | 6/1953 | Claude | 315/179 X |
| 3,268,756 | 8/1965 | Dauray | 313/161 |
| 3,813,576 | 5/1974 | Caprari | 315/49 X |
| 3,826,569 | 7/1974 | Sakamaki et al. | 355/69 X |
| 3,976,910 | 8/1976 | Owens et al. | 315/92 |
| 4,009,412 | 2/1977 | Latassa | 315/106 |
| 4,060,751 | 11/1977 | Anderson | 315/209 R |
| 4,100,446 | 7/1978 | Harada et al. | 313/161 |
| 4,100,462 | 7/1978 | McLellan | 315/179 |

FOREIGN PATENT DOCUMENTS

| | | | |
|---|---|---|---|
| 1144401 | 2/1963 | Fed. Rep. of Germany | 315/106 |

OTHER PUBLICATIONS

Amick, *Fluorescent Lighting Manual*, McGraw-Hill, 1947, pp. 52, 53.

*Primary Examiner*—Eugene R. La Roche

[57] ABSTRACT

Ballasting for a fluorescent lamp is provided by one or more incandescent lamps connected in series between the line voltage source and the fluorescent lamp. Lamp operation is initiated by a triggering pulse applied to a conductive member placed adjacent the fluorescent lamp. In one embodiment, a plurality of incandescent lamps are connected in parallel and are selectively gated into the circuit depending upon exposure requirements for the lamp.

9 Claims, 4 Drawing Figures

FLUORESCENT LAMP WITH INCANDESCENT BALLASTING SYSTEMS

BACKGROUND OF THE INVENTION

This invention relates to fluorescent lamps and more particularly to a fluorescent lamp which uses incandescent lamps as the lamp ballasting circuit.

Ballasting circuits are generally required for stable and efficient operation of fluorescent lamps. Under operating conditions, the lamp appears as a negative impedance device so a magnetic ballast device is normally used to provide a balancing positive series impedance thereby stabilizing operation. For certain applications, such as illumination sources in a photocopier machine, operating voltage requirements are such that the open circuit voltages must be higher than the ac line voltage ($\approx$105 VAC). In addition, a starting aid potential (SAV) required to initiate discharge is substantially higher (typically 450 volts peak) than the line voltage. Auxiliary starting circuits are generally used in these applications to provide the SAV for the relatively short time needed to initiate discharge. The conventional magnetic ballasts can be designed to provide the required open circuit and starting aid voltages while also providing current limiting and some level of regulation.

The conventional magnetic ballasts however, have some drawbacks, depending on use made of the lamp. For example, they do have appreciable weight which may be a detriment to portable applications. The magnetic ballast is also a relatively high cost item.

A potential answer to the above problems is the use of incandescent lamps to provide the required ballast characteristics. Such ballasting techniques are known in the art (see "Fluorescent Lighting Manual" by Charles L. Amick, published 1947 by McGraw Hill, pages 53, 53). Such techniques, while attractive because of the lower cost of incandescent lamps, however, have not proved commercially practical since it has proved difficult to provide an open circuit voltage that is higher than the line voltage.

It is, therefore, an object of the present invention to provide a fluorescent lamp incandescent ballasting system which provides reliable starting conditions.

It is a further object to provide a ballasting system which is lighter and less costly than magnetic ballast systems.

SUMMARY

The above objects are realized in a lamp and ballast system comprising at least one incandescent lamp connected between the lamp electrodes and the line source, and means for applying a high voltage trigger probe to the lamp.

DRAWINGS

DESCRIPTION

Figure 1:
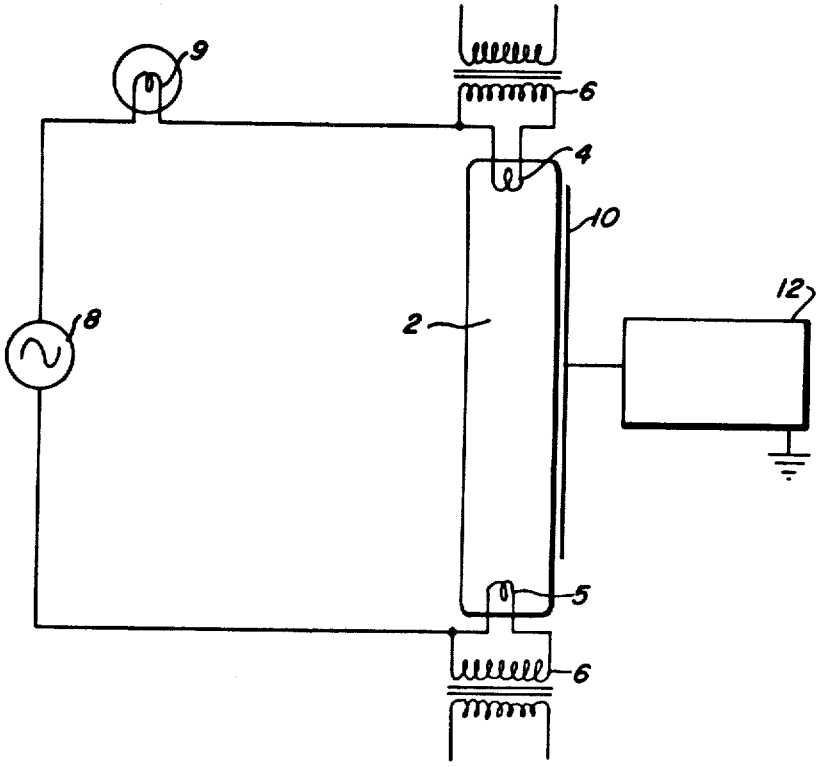
FIG. 1 shows a first embodiment incandescent ballasting circuit according to the invention.

Referring to FIG. 1, a rapid start fluorescent lamp 2 is provided at each end thereof with filaments 4,5. The filaments are generally constructed of an oxide coated tungsten. Conventional filament transformer 6, supplies the required filament preheat voltage simultaneously with the open circuit voltage across the lamp provided by ac source 8. Incandescent device 9, connected between source 8 and the lamps can be a conventional incandescent lamp. Conductive plane 10 is located adjacent to and substantially parallel to the longitudinal envelope surface of lamp 2. Plane 10 can, for example, be directly attached to the lamp using an adhesive. A triggering voltage is applied to plane 10 by a high voltage trigger circuit 12.

For purposes of explaining the operation of the circuit, it will be assumed that a 115 VAC system operates at a low line condition of 105 VAC. The open circuit voltage would be approximately 105 VAC plus 6 volts for the lamp filaments for a total of 111 VAC. For reliable lamp starting, an open circuit voltage greater than 125 VAC would be required for a 22.5 (56.15 cm), T-8 lamp. This voltage is obtainable with the use of the conventional magnetic ballast that provides a voltage stepup but would not be obtainable when the incandescent device 9 is used as the ballast. The present invention therefore, is further directed towards alternate means of initiating lamp discharge which would permit use of the incandescent ballasting. Such a means is provided by the application of a triggering circuit represented by conductive plane 10 powered by trigger power supply 12. For the above values, a high voltage pulse of 750 volts peak would be required to initiate discharge.

In operation then, the trigger pulse would be applied to conductive plane 10, lowering the resistance of the gaseous medium within the tube and initiating flash discharge as the ac line voltage is applied across the lamp filaments. Device 9 provides the required ballast during operation.

Figure 2:
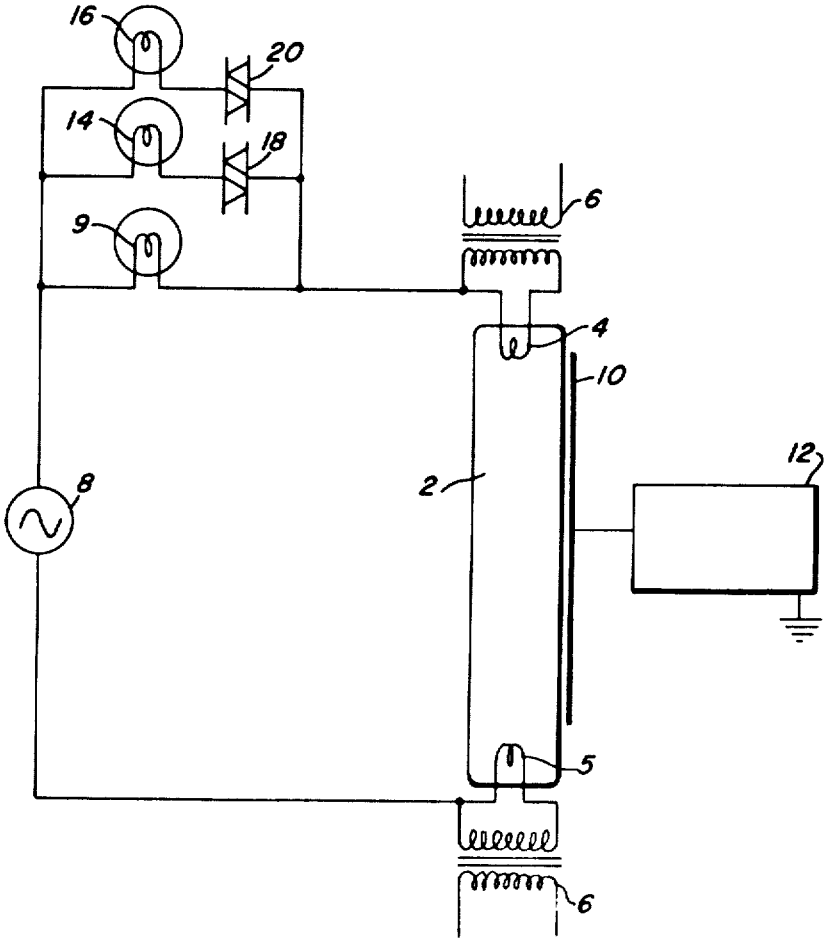
FIG. 2 shows a second incandescent ballast circuit having multiple incandescent devices connected in parallel.

FIG. 2 illustrates a second embodiment of an incandescent ballasting system. In certain applications, operating conditions may require changes in the radiometric output of the lamp. For example, exposure requirements are generally altered during magnification change. The circuit of FIG. 2 is basically that of FIG. 1 with the addition of incandescent devices 14,16 connected in parallel with device 9. These devices can be switched into the circuit at times corresponding to exposure changes, applying appropriate gating voltages to triacs 18 and 20. Depending on the characteristics of the devices, they produce variations in the lamp current and hence, vary the radiometric output of the lamp.

Figure 3:
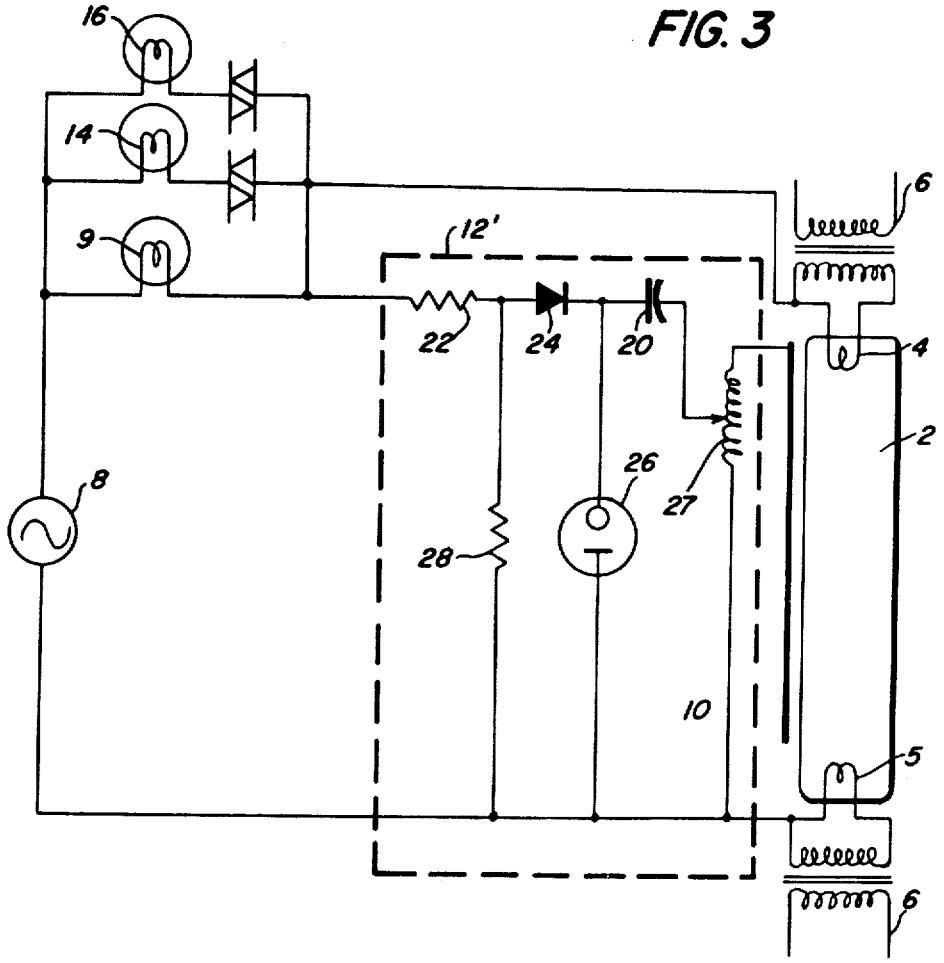
FIG. 3 shows a preferred embodiment of a triggering circuit used with the circuit of FIG. 2.

FIG. 3 illustrates a preferred embodiment for the high voltage trigger circuit. Circuit 12' is now connected so as to operate directly off the 115 VAC line. The ac line voltage is applied to lamp 2 and to trigger circuit 12' through the incandescent devices 9,14,16. Since the line voltage is generally insufficient to initiate discharge of lamp 2, the line voltage will rapidly build up across capacitor 20 through resistor 22 and diode 24. When the voltage across arc lamp 26 is greater than its arc-over voltage, the lamp begins to conduct, discharging the capacitor through the primary of transformer 27. This produces a high voltage pulse at the transformer secondary which is transmitted to conductive plane 10, initiating ionization within lamp 2, causing it to conduct. The voltage across lamp 26 then drops to a value lower than its arc-over voltage, turning lamp 26 off, thereby disabling the trigger circuit. Resistors 22 and 28 provide adjustment of this "cutout" voltage. Typical components for a 60 HZ 115 VAC system driving a 22½" T8 rapid start fluorescent lamp would be:

resistor 22—18K ohms
resistor 28—82K ohms
capacitor 20—0.1 uf
lamp 26—TP100 (SIGNALITE)
transformer 27—STANCOR P-6426
diode 24—/N 2004

The ballasting circuits, as shown in FIGS. 1-3, may also be used to accomplish other purposes. The incandescent devices, during operation, dissipate energy in the form of heat and light. These byproducts can be useful to supplement certain xerographic functions. As one example, in the copier system shown in FIG. 4, fluorescent lamps 30 and 32 are the prime source for illuminating a document 34 placed on curved object plane 36. The document image is reflected from oscillating scan mirror 38, projected through lens 40 and onto photosensitive drum 42 via mirror 44 creating a latent image thereon. Incandescent lamps 46 and 48 are located to provide "fill-in" illumination so as to achieve, for example, uniform illumination of the document. (Electrical connections have been omitted to simplify description).

Figure 4:
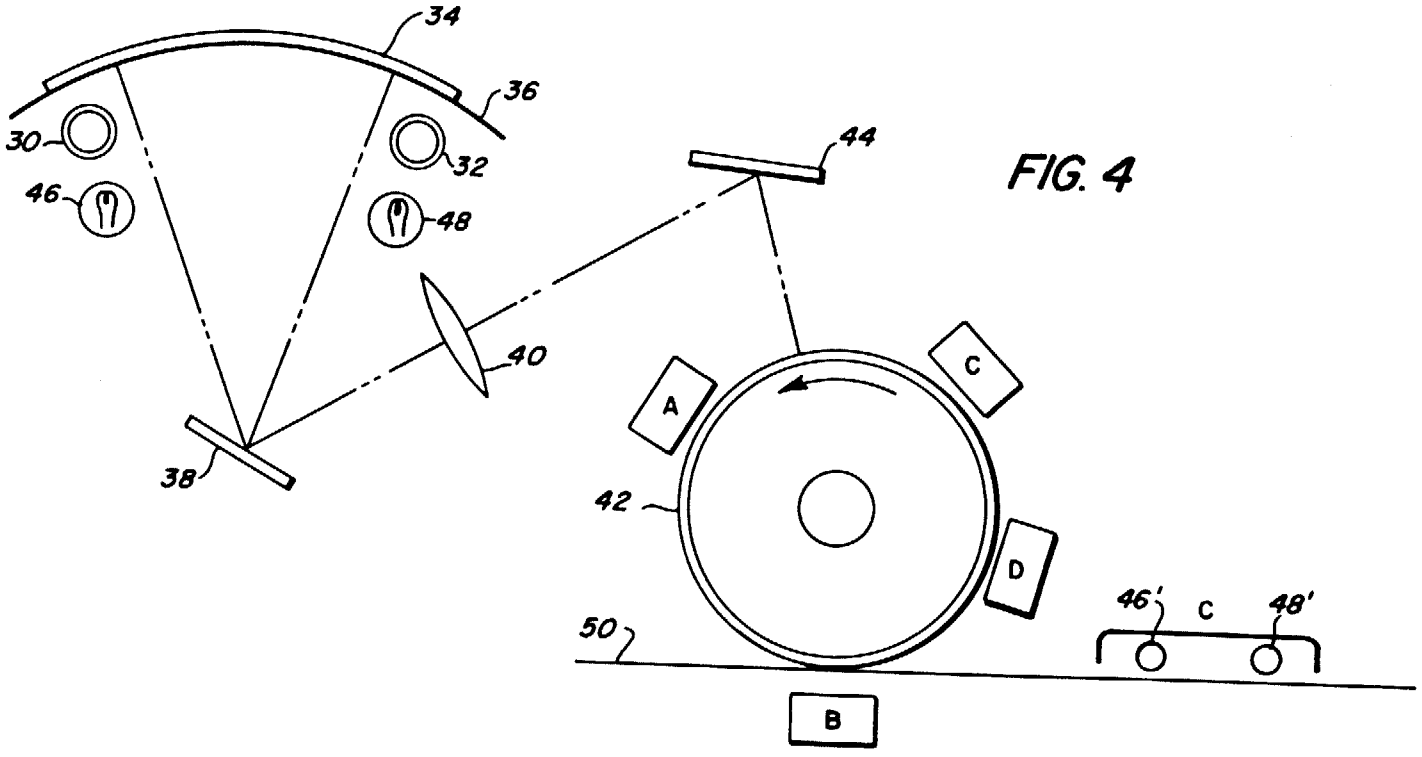
FIG. 4 shows the circuit of FIG. 2 as used to supplement various functions in a xerographic copier.

The incandescent lamps could also be located in other areas of the xerographic system depicted in FIG. 4. One such use is to provide supplementary heat at a copy fusing station. As shown in FIG. 4, following exposure of drum 48, the latent image is developed at station A by application of toner material of appropriate polarity. The developed image is brought into contact with a sheet of support material 50 within a transfer station B and the toner image is electrostatically attracted from the surface of drum 48 to the contacting side of the support material. Sheet 50 then advances to a radiant fusing station C where the image is fixed in final form. Lamps 46', 48' are shown located within the fushing station C where they provide a portion of the required heat. Cleaning and charging of the belt following the transfer step are accomplished at station D and E in a manner well known in the art.

Although not shown in the figure, lamps 46, 48 or additional lamps (not shown) could be adapted to illuminate and expose selected areas of belt 46 so as to achieve interdocument and/or edge erase.

It is obvious to one skilled in the art that other changes, modifications, etc. may be made to the above described embodiments while still retaining the concepts of the invention. For example, the trigger circuit shown in FIG. 3 has applicability in other types of circuits such as a dc system, using solid state control devices. Also, the ballast mechanism could be resistive, reactive, and incandescent. The circuit could also use standard trigger transformers or piezoelectric materials, and could readily substitute a suitable semiconductor device or devices for the lamp. Instead of an arc lamp in the circuit of FIG. 3, a voltage sensing semiconductor switch such as a zener diode could be used. The main requirement is that the device trigger at a set level to discharge the capacitor.

I claim:

1. An incandescent ballasting circuit for a fluorescent lamp comprising:

at least one incandescent device connected between an electrical power source and fluorescent lamp, means for applying a preheat voltage to the fluorescent lamp filaments, and means for applying a trigger voltage to said fluorescent lamp sufficient to initiate lamp discharge said triggering voltage means including:

a conductive plane adjacent to said fluorescent lamp, a transformer electrically connected to said conductive plane, and a pulse generating circuit connected between said incandescent device and said transformer, said circuit adapted to operate from said power source to generate a high voltage pulse and apply said pulse to said lamp via the transformer and conductive plane, initiating lamp discharge, said circuit means further adapted to be disabled following initiation of lamp discharge.

2. A xerographic copier for exposing a document onto an imaging plane, said copier including:

an exposure station for relatively uniform illumination of document, means for projecting an image of said document onto a photosensitive imaging plane, thereby forming a latent image of said document, said exposure station including:

a fluorescent lamp, at least one incandescent device connected between an electrical power line source and the fluorescent lamp, means for applying a preheat voltage to the fluorescent lamp filaments, and means for applying a triggering voltage to said fluorescent lamp sufficient to initiate lamp discharge said triggering voltage means including:

a conductive plane adjacent to said fluorescent lamp, a transformer electrically connected to said conductive plane, and a pulse generating circuit connected between said incandescent device and said transformer, said circuit adapted to operate from said power source to generate a high voltage pulse and apply said pulse to said lamp via the transformer and conductive plane, initiating lamp discharge, said circuit means further adapted to be disabled following initiation of lamp discharge.

3. The copier of claim 2 wherein said pulse generating circuit includes a capacitor connected in series between said transformer and said incandescent lamp and a voltage sensing conductive device connected across the ac line terminals, said capacitor adapted to accumulate a charge during line voltage buildup, said charge being released through said transformer upon initiation of conduction of the conductive device.

4. The circuit of claim 3, further including means for setting the voltage drop which will initiate conduction of said conductive device.

5. The ballasting circuit of claim 3 or 4 wherein said sensing device is an arc lamp.

6. The ballasting circuit of claim 3 or 4 wherein said sensing means is a voltage sensing semiconductor switch.

7. The copier of claim 2 wherein said incandescent device is located so as to provide an additional component of light to the illumination of said document.

8. The copier of claim 2 further including a heat fusing station for fusing an image developed in said image plane and transferred onto a copy paper said incandescent device being located so as to provide an additional component of heat at said fusing station.

9. The copier of claim 2 wherein said incandescent device is located so as to selectively dissipate selected portions of said imaging plane.

* * * * *